US006885343B2

(12) United States Patent
Roper

(10) Patent No.: US 6,885,343 B2
(45) Date of Patent: Apr. 26, 2005

(54) STRIPLINE PARALLEL-SERIES-FED PROXIMITY-COUPLED CAVITY BACKED PATCH ANTENNA ARRAY

(75) Inventor: Joel C. Roper, Plano, TX (US)

(73) Assignee: Andrew Corporation, Orland Park, IL (US)

( * ) Notice: Subject to any disclaimer, the term of this patent is extended or adjusted under 35 U.S.C. 154(b) by 293 days.

(21) Appl. No.: 10/255,305

(22) Filed: Sep. 26, 2002

(65) Prior Publication Data

US 2004/0061647 A1 Apr. 1, 2004

(51) Int. Cl.[7] ..... H01Q 1/38
(52) U.S. Cl. ..... 343/700 MS; 343/824
(58) Field of Search ..... 343/700 MS, 824, 343/846, 776, 893

(56) References Cited

U.S. PATENT DOCUMENTS

| | | | | |
|---|---|---|---|---|
| 3,728,733 | A | 4/1973 | Robinson | 343/765 |
| 3,731,315 | A | 5/1973 | Sheleg | 343/854 |
| 4,032,922 | A | 6/1977 | Provencher | 343/854 |
| 4,063,245 | A | 12/1977 | James et al. | 343/700 MS |
| RE29,911 | E | 2/1979 | Munson | 343/700 |
| 4,180,817 | A | 12/1979 | Sanford | 343/700 MS |
| 4,189,675 | A | 2/1980 | Frosch et al. | 325/4 |
| 4,197,545 | A | 4/1980 | Favaloro et al. | 343/700 MS |
| 4,246,585 | A | 1/1981 | Mailloux | 343/854 |
| 4,287,518 | A | 9/1981 | Frosch et al. | 343/700 MS |
| 4,291,312 | A | 9/1981 | Kaloi | 343/700 MS |
| 4,318,104 | A | 3/1982 | Enein | 343/100 LE |
| 4,338,605 | A | 7/1982 | Mims | 343/100 LE |
| 4,348,253 | A | 9/1982 | Subbarao et al. | 156/643 |
| 4,352,202 | A | 9/1982 | Carney | 455/151 |
| 4,394,629 | A | 7/1983 | Kumar et al. | 333/109 |
| 4,407,001 | A | 9/1983 | Schmidt | 343/840 |
| 4,409,595 | A | 10/1983 | Park | 343/771 |
| 4,446,463 | A | 5/1984 | Irzinski | 343/371 |
| 4,475,107 | A | 10/1984 | Makimoto et al. | 343/700 MS |
| 4,605,931 | A | 8/1986 | Mead et al. | 343/700 |
| 4,686,535 | A | 8/1987 | Lalezari | 343/700 MS |
| 4,710,775 | A | 12/1987 | Coe | 343/727 |
| 4,713,670 | A | 12/1987 | Makimoto et al. | 343/700 MS |
| 4,806,937 | A | 2/1989 | Peil | 342/175 |
| 4,833,482 | A | 5/1989 | Trinh et al. | 343/700 MS |
| 4,843,402 | A | 6/1989 | Clement | 343/758 |
| 4,847,626 | A | 7/1989 | Kahler et al. | 343/700 MS |
| 4,849,763 | A | 7/1989 | DuFort | 342/372 |
| 4,870,421 | A | 9/1989 | Peil et al. | 342/175 |
| 4,879,711 | A | 11/1989 | Rosen | 370/50 |

(Continued)

FOREIGN PATENT DOCUMENTS

| | | |
|---|---|---|
| GB | 2 286 749 A | 8/1995 |
| WO | WO 98/11626 | 3/1998 |

OTHER PUBLICATIONS

Huang, John, "*A Parallel–Series–Fed Microstrip Array with High Efficiency and Low Cross–Polarization*", (Reprinted from Microwave and Optical Tech. Lett., vol. 5, No. 5, John Wiley and Sons, (May 1992), pp. 230–233), pp. 305–308.

Duffy, Sean M. et al., *A Modified Transmission Line Model for Cavity Backed Microstrip Antennas,* IEEE No. 0–7803–4178–Mar. 1997, pp. 2139–2142.

Duffy, Sean M., "An Enhanced Bandwidth Design Technique for Electromagnetically Coupled Microstrip Antennas", *IEEE Transactions on Antennas and Propagation,* vol. 48, No. 2, (Feb. 2000), pp. 161–164.

*Primary Examiner*—Shih-Chao Chen
(74) *Attorney, Agent, or Firm*—Wood, Herron & Evans, LLP

(57) ABSTRACT

An antenna array having one or more multi-layer substrates each including top and bottom ground planes and an inner conductive layer, a plurality of proximity coupled cavity backed patch antenna elements formed by each multi-layer substrate, and distribution traces extending along the inner conductive layer of the substrates and coupling with the proximity coupled cavity backed patch antenna elements.

41 Claims, 3 Drawing Sheets

U.S. PATENT DOCUMENTS 4,899,163 A 2/1990 Daniel et al. ..... 434/700 MS
4,929,959 A 5/1990 Sorbello et al. ..... 343/700 MS
4,972,196 A 11/1990 Mayes et al. ..... 343/700 MS
4,973,971 A 11/1990 Sinsky et al. ..... 342/373
4,973,972 A 11/1990 Huang ..... 343/700 MS
4,994,813 A 2/1991 Shiramatsu et al. ..... 342/360
5,006,858 A 4/1991 Shirosaka ..... 343/700
5,017,931 A 5/1991 Carlyon ..... 33/700 MS
5,019,793 A 5/1991 McNab ..... 333/156
5,068,670 A 11/1991 Maoz ..... 343/767
5,086,302 A 2/1992 Miller ..... 342/373
5,089,823 A 2/1992 Vasile ..... 342/383
5,117,377 A 5/1992 Finman ..... 364/578
5,128,687 A 7/1992 Fay ..... 343/754
5,160,906 A 11/1992 Siomkos et al. ..... 333/204
5,212,494 A 5/1993 Hofer et al. ..... 343/859
5,220,335 A 6/1993 Huang ..... 343/700 MS
5,233,361 A 8/1993 Boguais ..... 343/700 MS
5,248,982 A 9/1993 Reinhardt et al. ..... 342/375
5,351,060 A 9/1994 Bayne ..... 343/766
5,412,414 A 5/1995 Ast et al. ..... 342/174
5,422,649 A 6/1995 Huang ..... 343/700
5,446,471 A 8/1995 Chung et al. ..... 343/770
5,455,594 A * 10/1995 Blasing et al. ..... 343/700 MS
5,461,393 A 10/1995 Gordon ..... 343/769
5,463,401 A 10/1995 Iwasaki ..... 342/359
5,485,170 A 1/1996 McCarrick ..... 343/895
5,486,835 A 1/1996 Hock ..... 342/359
5,488,380 A 1/1996 Harvey et al. ..... 342/368
5,499,005 A 3/1996 Gu et al. ..... 333/246
5,502,372 A 3/1996 Quan ..... 324/72.5
5,512,906 A 4/1996 Speciale ..... 342/375
5,515,057 A 5/1996 Lennen et al. ..... 342/357
5,589,843 A 12/1996 Meredith et al. ..... 343/820
5,633,647 A 5/1997 Tines ..... 343/766
5,648,786 A 7/1997 Chung et al. ..... 343/770
5,663,736 A 9/1997 Webb et al. ..... 342/375
5,724,049 A 3/1998 Park et al. ..... 343/705
5,726,664 A 3/1998 Park et al. ..... 343/705
5,754,138 A 5/1998 Turcotte et al. ..... 342/373
5,754,139 A 5/1998 Turcotte et al. ..... 342/373
5,757,246 A 5/1998 Johnson ..... 333/12
5,757,320 A 5/1998 McEwan ..... 342/387
5,758,287 A 5/1998 Lee et al. ..... 455/450
5,767,807 A 6/1998 Pritchett ..... 342/374
5,774,091 A 6/1998 McEwan ..... 342/387
5,777,581 A 7/1998 Lilly et al. ..... 343/700 MS
5,805,110 A 9/1998 McEwan ..... 342/387
5,856,804 A 1/1999 Turcotte et al. ..... 342/371
5,905,462 A 5/1999 Hampel et al. ..... 342/372
5,940,044 A 8/1999 Smith ..... 343/810
5,943,016 A 8/1999 Snyder, Jr. et al. ... 343/700 MS
6,025,803 A 2/2000 Bergen et al. ..... 343/700 MS
6,043,790 A 3/2000 Derneryd et al. ..... 343/853
6,067,053 A 5/2000 Runyon et al. ..... 343/797
6,081,234 A 6/2000 Huang et al. ..... 343/700 MS
6,087,989 A 7/2000 Song et al. ..... 343/700 MS
6,115,762 A 9/2000 Bell et al. ..... 710/62
6,121,936 A 9/2000 Hemming et al. ..... 343/769
6,133,868 A 10/2000 Butler et al. ..... 342/174
6,157,340 A 12/2000 Xu et al. ..... 342/174
6,157,343 A 12/2000 Andersson et al. ..... 342/371
6,157,344 A 12/2000 Bateman et al. ..... 343/700 MS
6,160,522 A 12/2000 Sanford ..... 343/769
6,198,460 B1 3/2001 Brankovic ..... 343/879
6,211,824 B1 * 4/2001 Holden et al. ..... 343/700 MS
6,218,990 B1 4/2001 Grangeat et al. .... 343/700 MS
6,222,503 B1 4/2001 Gietema et al. ..... 343/890
6,225,959 B1 5/2001 Gordon ..... 343/769
6,292,141 B1 9/2001 Lim ..... 343/700 MS
6,297,774 B1 10/2001 Chung ..... 343/700
6,300,906 B1 10/2001 Rawnick et al. ..... 343/700
6,307,525 B1 10/2001 Bateman et al. ..... 343/853
6,335,703 B1 1/2002 Chang et al. ..... 343/700 MS
6,342,868 B1 1/2002 Tsai et al. ..... 343/795
6,343,208 B1 1/2002 Ying ..... 455/90
6,411,258 B1 * 6/2002 Ho ..... 343/700 MS
6,445,346 B2 * 9/2002 Fathy et al. ..... 343/700 MS
6,529,166 B2 * 3/2003 Kanamaluru ..... 343/700 MS
6,583,766 B1 * 6/2003 Rawnick et al. ..... 343/841

* cited by examiner

STRIPLINE PARALLEL-SERIES-FED PROXIMITY-COUPLED CAVITY BACKED PATCH ANTENNA ARRAY

FIELD OF THE INVENTION

This invention generally relates to antennas, and more particularly to planar antenna arrays.

BACKGROUND OF THE INVENTION

In the provision of wireless communication services within a cellular network, individual geographic areas or "cells" are defined and serviced by base stations. A base station typically has a cellular tower and utilizes RF antennas that communicate with wireless devices, such as cellular phones and pagers. The base stations are linked with other facilities of the service provider, such as a switching or central office, for handling and processing the wireless communication traffic.

A base station may be coupled to a processing facility through cables or wires, referred to as land lines, or alternatively, the signals may be transmitted or backhauled through microwave backhaul antennas, also located on the cellular tower and at the facility. Backhauls may be used in situations where land lines are unavailable or where a service provider faces an uncooperative local carrier and wants to ensure independent control of the circuit. In such a scenario, the backhaul may be referred to as a point-to-point backhaul, referencing the base station and the processing facility as points.

Point-to-point backhauls, are currently being deployed in the unlicensed spread spectrum bands, (e.g. Industrial, Scientific, and Medical (ISM) band covering 902–928 MHz, Unlicensed National Information Infrastructure band (U-NII) at 5.15–5.25 GHz, 5.25–5.35 GHz, and 5.725–5.825 GHz, etc.), to avoid the cost and time delays associated with installation in licensed frequency bands. One type of antenna that may be used for point-to-point backhauls utilizes a parabolic dish that is mounted to a tower, a wall, a building or in another location, and aimed at the other point in the backhaul. Parabolic dishes are sometimes unsightly and spoil the aesthetic appearance of the location where they are mounted.

Another type of antenna that may be used for point-to-point backhauls is a planar antenna array. Planar antenna arrays may also be mounted to a tower, a wall or a building, with the antenna being electrically pointed, i.e., via beamsteering, at the other point in the backhaul. Planar antenna arrays are generally thought of as more aesthetically appealing than parabolic dishes. Moreover, beamsteering makes planar antenna arrays more desirable in reconfiguring a cellular network. However, planar antenna arrays generally suffer from a variety of limitations.

For instance, planar antennas arrays tend to be constructed using arrays of patch radiating elements. In order to form these elements and ease manufacturing, planar antennas may be constructed using printed circuit boards. However, these boards often utilize multiple layer construction techniques in order to form the elements and the feed networks used therewith. Such construction increases the cost of such boards.

Moreover, planar antennas constructed using arrays of patch radiating elements formed using multiple layer circuit boards typically use corporate feed networks for coupling the elements in the arrays. Such corporate feed networks are often in the form of microstrip or twin-lead feed lines deposited on one or more layers of a circuit board. Such corporate feed networks typically have high losses, while such microstrip or twin-lead feed lines typically result in poor cross-polarized performance of an antenna.

In addition, the use of multiple layer circuit boards may economically and/or practically limit the size of the antenna. For example, current production capabilities of circuit board suppliers, along with the production costs associated with constructing a circuit board larger than currently available, limit the size of multiple layer circuit boards. Further, techniques of coupling two or more circuit boards together, thereby realizing a larger circuit board, are largely thwarted as interconnection of multiple conductive layers in each board tends to be impractical. Due to these economic and practical limitations in the size of circuit boards available, planar antennas constructed using such circuit boards may be limited in aperture size, i.e., the distance between the outer two most arrays of elements in an antenna, which determines in part the ability to electrically point the antenna.

Thus, these limitations typically associated with planar antennas may reduce antenna performance, efficiency and increase amplification requirements, and may limit the ability to electrically point such an antenna.

Therefore, a need exists for a low cost, low loss, large aperture planar antenna having an improved front-to-back ratio and cross-polarized performance with reduced susceptibility to other sources of radiation for applications such as a point-to-point microwave backhaul.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE DRAWINGS

The present invention provides a stripline parallel-series fed proximity-coupled cavity backed patch antenna array. By using a two dimensional stripline feed for improved isolation and cross-polarization for coupling proximity-coupled cavity backed microstrip patch elements, a large aperture antenna is provided using one or more multi-layer substrates. Such an antenna allows the use of adaptive beamforming for beamsteering and/or null forming thereby reducing susceptibility to other sources of radiation for applications such as a point-to-point microwave backhaul.

Figure 1:
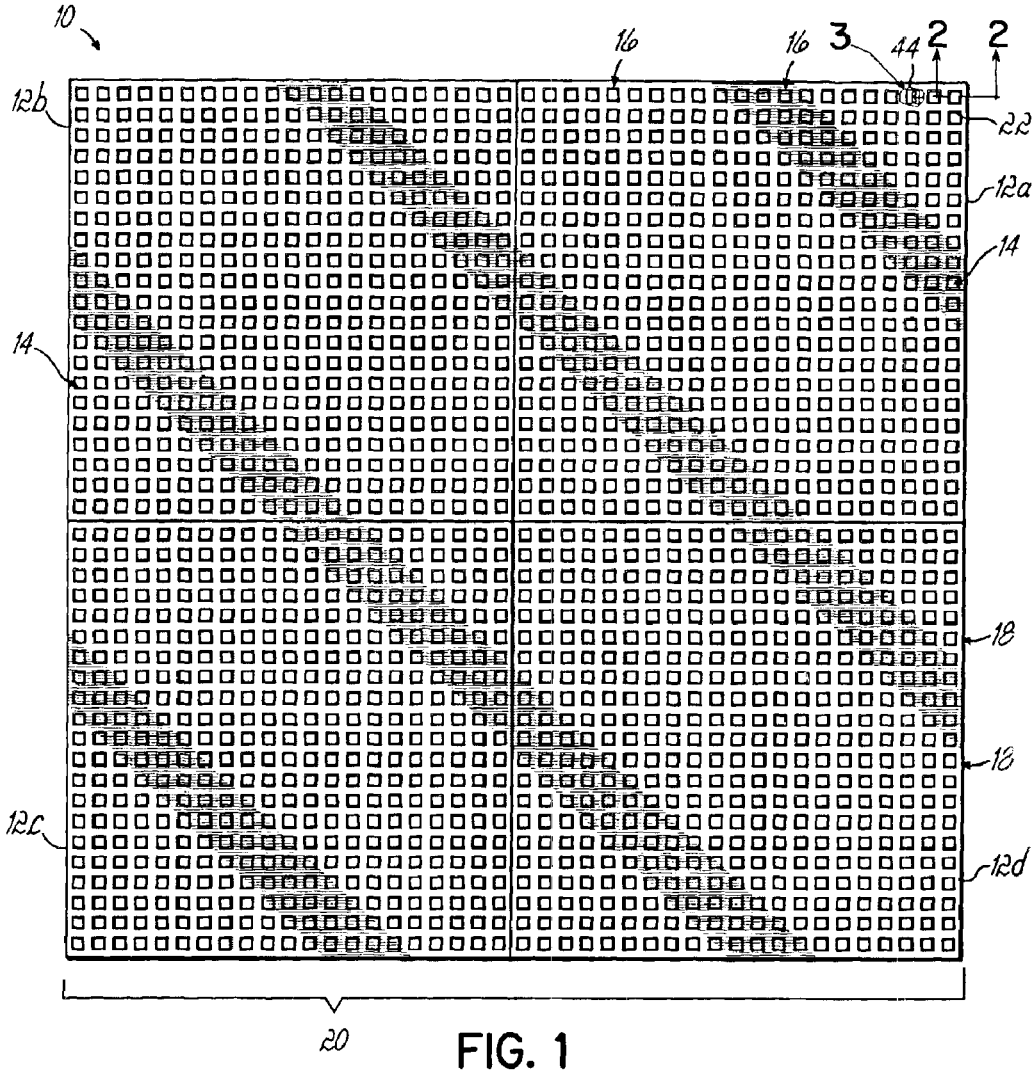
FIG. 1 is a diagram showing an antenna array in accordance with the principles of the present invention.

Referring initially to FIG. 1, there is shown an exemplary stripline parallel-series fed proximity coupled cavity backed patch antenna array 10 for purposes of explaining the present invention. Antenna array 10 may be configured to provide a point-to-point backhaul in one of the unlicensed spread spectrum bands referred to hereinbefore. As will be appreciated by those skilled in the art, other embodiments of the present invention may be configured for other applications besides a point-to-point backhaul. Moreover, embodiments of the present invention may be configured for operation in either other unlicensed or licensed frequency bands.

Antenna array 10 comprises a plurality of multi-layer substrates 12*a–d* and a plurality of antenna elements 14 formed by the multi-layer substrates 12*a–d*. The antenna elements 14 may be proximity coupled cavity backed patch elements as illustrated.

The antenna elements 14 may be formed in a series of columns 16, to allow beamsteering and/or null forming, and rows 18. Each multi-layer substrate 12*a–d* in FIG. 1 includes twenty-one columns 16 containing twenty-one rows 18; thus, antenna array 10 comprises 42 columns and 42 rows. However, those skilled in the art will readily appreciate that any number of columns and rows may be used without departing from the spirit of the present invention. Moreover, an antenna array consistent with the present invention need not constitute rows per se.

Each multi-layer substrate 12*a–d* is advantageously within current production capabilities of circuit board manufactures. The use of multi-layer substrates 12*a–d* facilitates an antenna of larger physical dimensions without incurring the costs associated with the production of a larger circuit board. However, it will be appreciated that as larger circuit boards become more economically viable in the future, the principles of the present invention apply equally to those larger circuit boards.

Thus, those skilled in the art will appreciate that embodiments of the present invention may use any number of multi-layer substrates as desired for economical and/or practical or other reasons. Further, the present invention need not constitute multiple substrates. Rather, embodiments of the present invention may use a single substrate should such a single substrate be desirable. Antenna array 10 merely uses four substrates 12*a–d* by way of example.

The larger dimensions of array 10, facilitates a larger aperture size 20, defined by the distance across the series of columns 16. As will be readily appreciated by those skilled in the art, a larger aperture 20 increases beamsteering ability, thereby increasing the flexibility in mounting the antenna array 10.

Each multi-layer substrate 12*a–d* is homogenous and mirrored in construction about the inner most edges of the substrates 12*a–d*, both horizontally and vertically, with respect to the other substrates 12*a–d*. Thus, for ease of explanation, FIGS. 2 and 3 refer to a cross section 22 and a portion 44 of multi-layer substrate 12*a*, respectively, whereas FIG. 4 illustrates an inner conductive layer 28 of multi-layer substrate 12*b*. In certain circumstances where differences in the multi-layer substrates further illustrate the principles of the present invention, those differences will be described in more detail, such as in FIG. 5.

Figure 2:
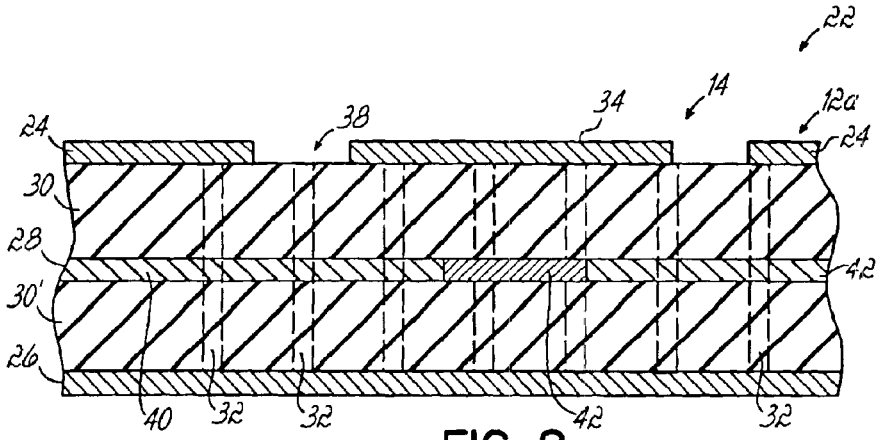
FIG. 2 is diagram showing a cross section of a portion of one of the multi-layer substrates used in the antenna array of FIG. 1, taken through line 2—2.

Referring now to FIG. 2, a cross-section 22 through line 2—2 of multi-layer substrate 12*a* in antenna array 10 is illustrated. Cross-section 22 of multi-layer substrate 12*a* typifies the construction of multi-layer substrates 12*a–d* as, again, the multi-layer substrates 12*a–d* are homogeneous. Cross-section 22 is taken through an antenna element 14 for purposes of further illustrating the formation of an antenna element 14.

Multi-layer substrate 12*a* comprises a top and bottom ground plane 24, 26 and an inner conductive layer 28, spaced by dielectric materials 30, 30' using techniques well know to those skilled in the art. Cut, etched or otherwise formed out of the top ground plane 24 is a radiating patch or patch 34. Multi-layer substrate 12*a* forms antenna element 14 by the element 14 including vias or plated through holes 32 connecting the top and bottom ground planes 24, 26 around a perimeter 36 (shown in FIG. 3). The plated through holes 32 are spaced relative to one another so that they electromagnetically form a cavity 38, below radiating patch 34, at the operating frequency of the antenna element 14. Those skilled in the art will appreciate that the width of the wall of plated through holes 30 may be made less than half a guide or stub 42 wavelength thereby eliminating propagation of real power from the cavity 38 due to waveguide modes.

The inner conductive layer 28 includes waveguide or stub 42 (shown in more detail in FIG. 3) and a distribution trace 40 (shown in more detail in FIG. 4). Stub 42 is located under patch 34 so that radiation from the stub 42 is contained within the cavity 38 and reradiated by the patch 34. Such an arrangement improves the front-to-back ratio performance of antenna array 10.

Figure 3:
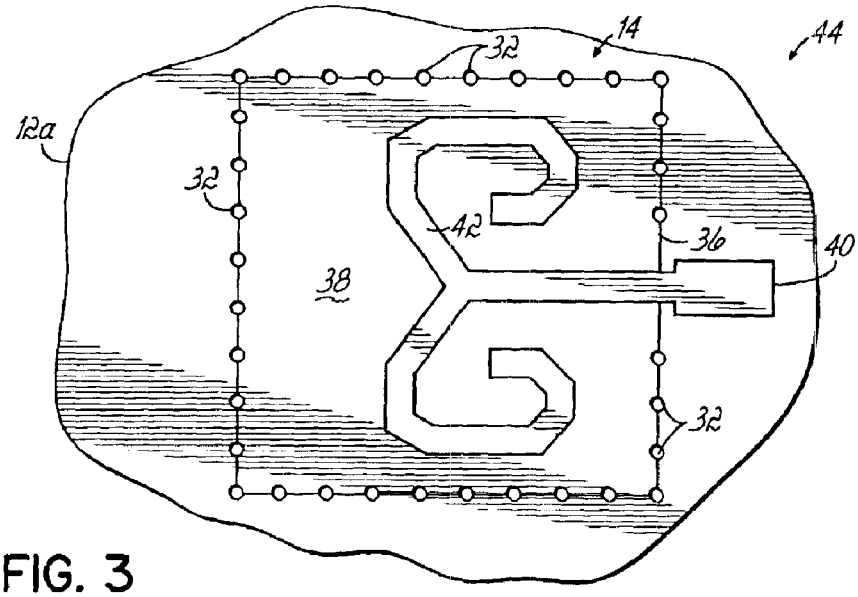
FIG. 3 is a top view of a portion of one of the multi-layer substrates forming a proximity coupled cavity backed patch element used in the antenna array of FIG. 1.
Figure 4:
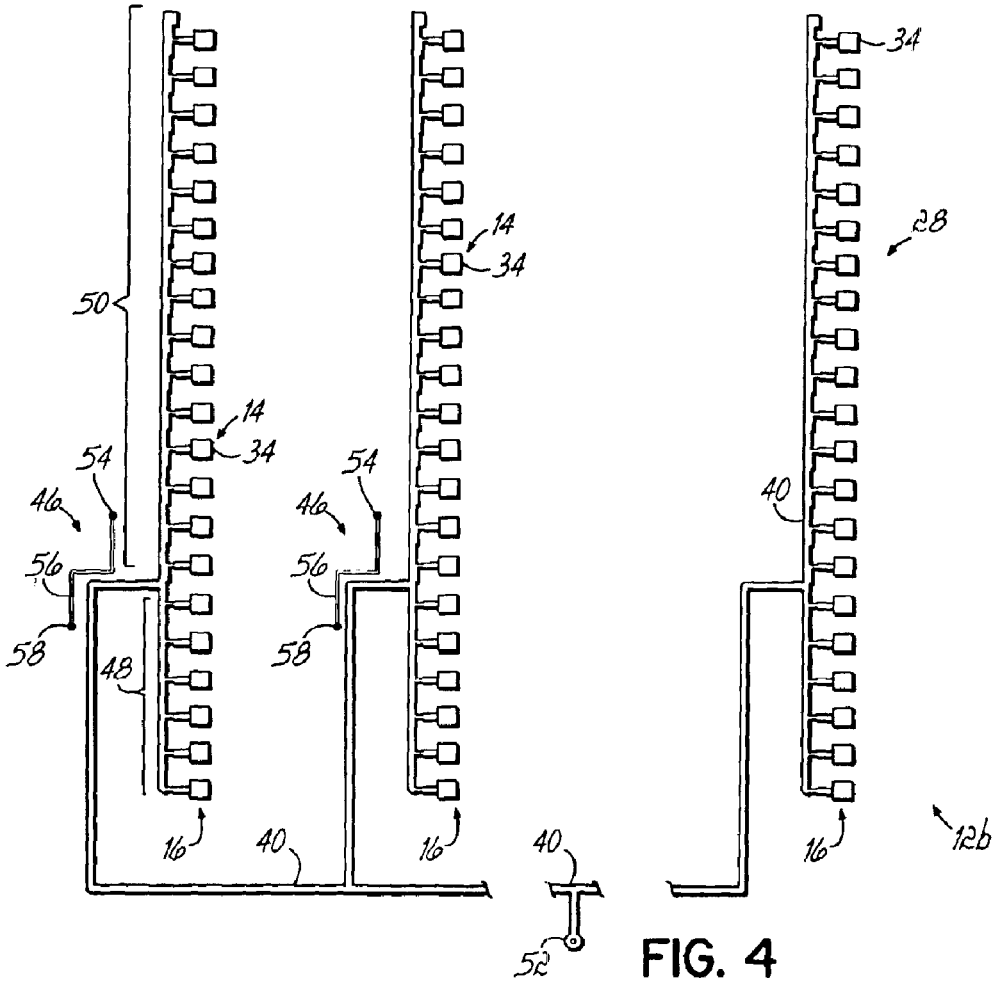
FIG. 4 is a diagram of an exemplary distribution trace including a coupler extending along the inner conductive layer of the multi-layer substrate of FIG. 2 and used in the antenna array of FIG. 1.

Referring now to FIG. 3, a top view 44 of a portion of multi-layer substrate 12*a* forming a proximity coupled cavity backed patch element 14 used in the antenna array 10 of FIG. 1 is shown. Element 14 includes plated through holes 32 connecting the top and ground planes 24, 26 around the perimeter 36 of the element 14 forming a cavity 38, as described in conjunction with FIG. 2. In FIG. 3, the patch 34 and top layer of dielectric material 30, both of which were shown in FIG. 2, have been removed to further illustrate stub 42. Stub 42 may advantageously be a dual three-quarter wavelength stub to achieve greater frequency variation. A more thorough description of such an antenna element may be found in "An Enhanced Bandwidth Design Technique for Electromagnetically Coupled Microstrip Antennas" by Sean M. Duffy, *IEEE Transactions on Antennas and Propagation*, Vol. 48, No. 2, February 2000, which is incorporated herein by reference in its entirety.

Referring to FIG. 4, a diagram of an exemplary distribution trace 40 including a coupler 56 extending along the inner conductive layer 28 of the multi-layer substrate 12*b* shown in FIG. 1 is illustrated. Portions of antenna elements 14, such as patches 34 have been included for additional reference thereby covering stubs 42 (shown in FIGS. 2 and 3). Distribution trace 40 is a tapered trace, the width of which is readily varied by those skilled in the art to effectuate parameters such as impedance, power, phase, etc. of an electrical signal carried by the trace 40. Distribution trace 40 also includes a feed connection 52. Distribution trace 40 may be referred to as a "stripline" by virtue of being located between two ground planes 24, 26 (shown in FIG. 2).

As illustrated, distribution trace 40 includes a uniform power distribution portion 48 and a tapered power distribution portion 50 for coupling radiating elements 14 within a column 16. Uniform and tapered power distribution to radiating elements 14 within the sections 48, 50 is accomplished through varying the width of the trace 40 as will be readily understood by those skilled in the art. Due to varying the width of the trace 40 in portions 48, 50, the power received or transmitted by the elements 14 in those sections 48, 50 is apportioned as desired. As such, those elements 14 in the uniform power distribution portion 48 may be referred to as connected in "parallel", whereas those elements in the tapered power distribution portion may be referred to as being connected in "series". Thus, distribution trace 40 may be referred to as a stripline parallel-series network that feeds proximity coupled cavity backed patch elements 14 in antenna array 10.

Advantageously extending along the inner conductive layer 28 of the multi-layer substrate 12*b* is a coupler 46 in the form of a trace 56. Coupler 46 includes a coupling connection 54. Coupler 56 may be optionally terminated with a load formed in trace 56, as indicated at reference numeral 58. Coupler 46 is formed by locating trace 56 proximate distribution trace 40 and adjacent a column 16. Coupling connection 54 allows a signal applied to the coupler 46 to vary, e.g. amplitude and/or phase, a signal applied through distribution trace 40 to a respective column 16. Thus, coupler 46 may be configured for beamforming, beamsteering and/or null forming antenna array 10. Those skilled in the art will readily appreciate that beamforming, beamsteering and/or null forming may be applied to any number or all of the columns 16 in antenna array 10, as desired.

Figure 5:
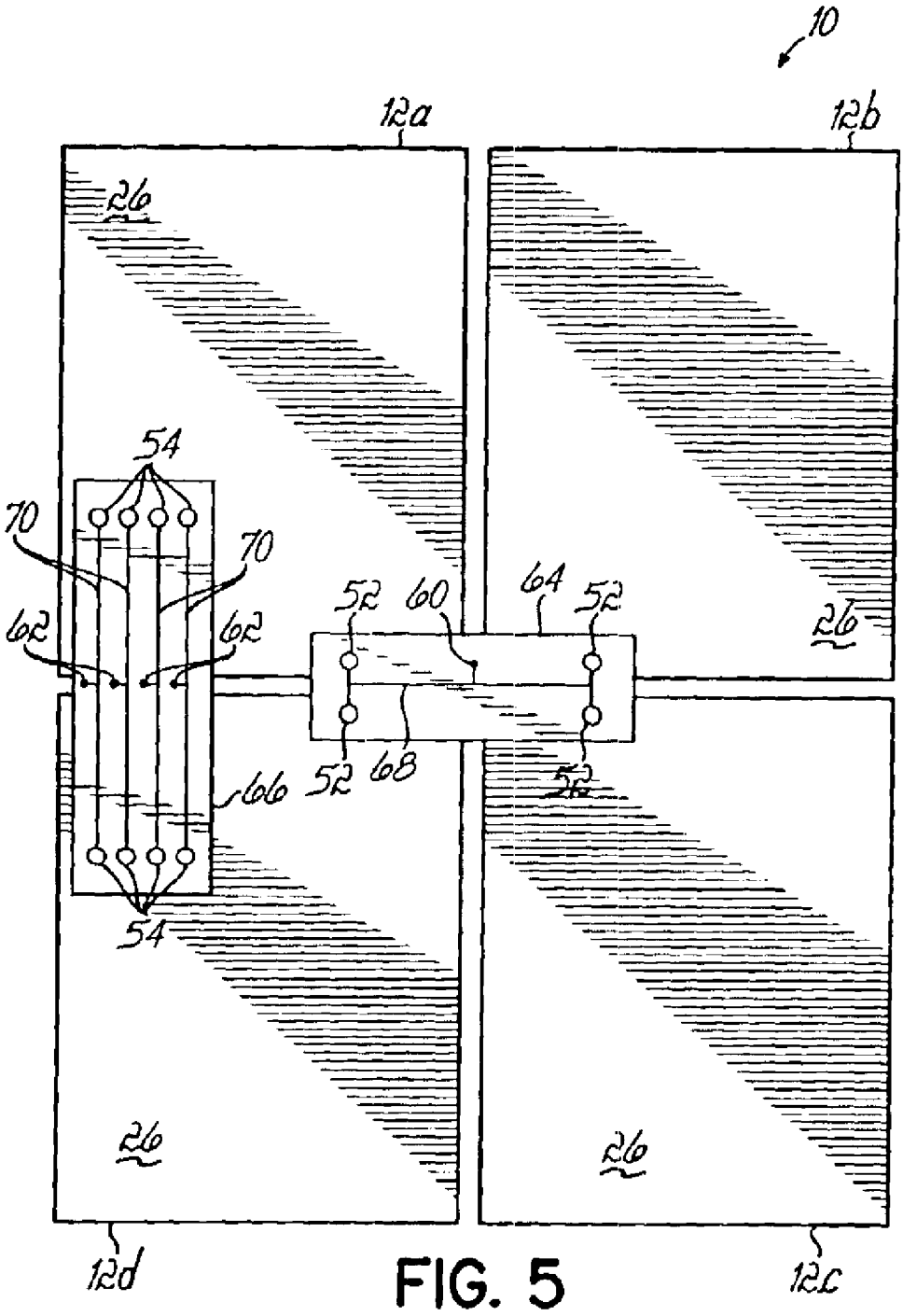
FIG. 5 is a diagram illustrating the assembly of the antenna array of FIG. 1.

Referring to FIG. 5, a diagram showing the assembly of the antenna array 10 of FIG. 1 is illustrated. In FIG. 5, multi-layer substrates 12*a–d* are shown from the side opposite that shown in FIG. 1, viewing bottom ground plane 26 as seen in FIG. 2. Areas in the bottom ground plane 26 have been etched away to facilitate feed connections 52 and coupling connections 54 formed in the inner conductive layer 28 shown in FIG. 4. For purposes of explanation feed connections 52 for all four multi-layer substrates 12*a–d* are shown, whereas coupling connections for only the outer most four columns 16 of multi-layer substrates 12*a* and 12*d* are shown.

As illustrated in FIG. 5, circuit boards 64, 66 are used for connections 52, 54, respectively. The circuit boards function to gather connections 52, 54 to reduce the number of cables that are needed for connection to antenna array 10.

Circuit board 64 comprises a feed combiner 68 that connects to the feed connections 52 of each distribution trace 40 of each multi-layer substrate 12*a–d* and includes a main feed 60 for the antenna array 10. Circuit board 66 comprises coupling combiners 70 that connect couplers, within a respectively column 16, on multi-layer substrates 12*a*, 12*d* and provides column connections 70 for beamforming, beamsteering and/or null forming. Those skilled in the art will appreciate that other manners of gathering connections 52, 54 to reduce the number of cables that are needed for connection to antenna array may be used as desired.

By virtue of the foregoing, there is thus provided a low cost, low loss, large aperture planar antenna having an improved front-to-back ratio and cross-polarized performance with reduced susceptibility to other sources of radiation for applications such as a point-to-point microwave backhaul.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details representative apparatus and method, and illustrative examples shown and described. Accordingly, departures may be made from such details without departure from the spirit or scope of applicant's general inventive concept.

What is claimed is:

1. An antenna array comprising:

a plurality of multi-layer substrates coupled to one another in a co-planar array, each including top and bottom ground planes and an inner conductive layer;

a plurality of proximity coupled cavity backed patch antenna elements disposed on the plurality of multi-layer substates, each proximity coupled cavity back patch antenna element including plated through holes connecting the top and bottom ground planes of a multi-layer substrate around an element perimeter; and a plurality of distribution traces extending along the inner conductive layer of the substrates and coupling with the proximity coupled cavity backed patch antenna elements.

2. The antenna array of claim 1, wherein the plurality of multi-layer substrates includes four multi-layer substrates arranged in two columns and two rows.

3. The antenna array of claim 1, wherein the distribution traces comprise stripline traces.

4. The antenna array of claim 1, wherein the distribution traces comprise a first portion coupling proximity coupled cavity back patch antenna elements in parallel and a second portion coupling proximity coupled cavity backed patch antenna elements in series.

5. The antenna array of claim 1, wherein the proximity coupled cavity backed patch antenna elements comprise three quarter wavelength dual stubs.

6. The antenna array of claim 1, further comprising a feed combiner electrically coupling the distribution traces of the plurality of multi-layer substrates.

7. The antenna array of claim 1, further comprising at least two couplers coupled to the distribution traces of at least two of the multi-layer substrates.

8. The antenna array of claim 7, wherein the couplers comprise traces extending along the inner conductive layer proximate the distribution traces.

9. The antenna array of claim 7, wherein the proximity coupled cavity backed patch antenna elements are formed in columns and the couplers are located proximate a respective column and configured for at least one of beamforming, beamsteering and null forming.

10. The antenna array of claim 7, wherein the couplers are terminated with a load.

11. The antenna array of claim 7, further comprising at least one coupling combiner configured to couple the at least two couplers.

12. An antenna array comprising:

multi-layer substrate, including top and bottom ground planes and an inner conductive layer;

a plurality of proximity coupled cavity backed patch antenna elements disposed on the multi-layer substrate, each proximity coupled cavity back patch antenna element including plated through holes connecting the top and bottom ground planes around an element perimeter; and at least one distribution trace extending along the inner conductive layer of the substrate and coupling with the proximity coupled cavity backed patch antenna elements.

13. The antenna array of claim 12, further comprises a second multi-layer substrate coupled to the first multi-layer substrate to forma coplanar array.

14. The antenna array of claim 12, wherein the at least one distribution trace comprises a stripline trace.

15. The antenna array of claim 12, wherein the distribution trace comprises a first portion coupling proximity coupled cavity back patch antenna elements in parallel and a second portion coupling proximity coupled cavity backed patch antenna elements in series.

16. The antenna array of claim 12, wherein the proximity coupled cavity backed patch antenna elements comprise three quarter wavelength dual stubs.

17. The antenna array of claim 12, further comprising at least one coupler coupled to the distribution trace of the multi-layer substrate.

18. The antenna array of claim 17, wherein the coupler comprises a trace extending along the inner conductive layer proximate the distribution trace.

19. The antenna array of claim 17, wherein the proximity coupled cavity backed patch antenna elements are formed in columns and the coupler is located proximate a respective column and configured for at least one of beamforming, beamsteering and null forming.

20. The antenna array of claim 17, wherein the coupler is terminated with a load.

21. A multi-layer substrate, comprising:

a top ground plane;

a bottom ground plane;

an inner conductive layer;

a plurality of proximity coupled cavity backed patch antenna elements, each proximity coupled cavity backed patch antenna element including plated through holes connecting the top and bottom ground planes around an element perimeter; and a distribution trace extending along the inner conductive layer of the substrate and coupling with the antenna elements.

22. The multi-layer substrate of claim 21, wherein the distribution trace comprises a stripline trace.

23. The multi-layer substrate of claim 21, wherein the distribution trace comprises a first portion coupling proximity coupled cavity backed patch antenna elements in parallel and a second portion coupling proximity coupled cavity backed patch elements in series.

24. The multi-layer substrate of claim 21, wherein the proximity coupled cavity backed patch antenna elements comprise three quarter wavelength dual stubs.

25. The multi-layer substrate of claim 21, further comprising at least one coupler coupled to the distribution trace of the inner conductive layer.

26. The multi-layer substrate of claim 25, wherein the at least one coupler comprises a trace extending along the inner conductive layer proximate the distribution trace.

27. The multi-layer substrate of claim 25, wherein the proximity coupled cavity backed patch antenna elements are formed in columns and the at least one coupler is configured for at least one of beamforming, beamsteering, and null forming.

28. The multi-layer substrate of claim 25, wherein the at least one coupler is terminated in a load.

29. A method of forming a multi-layer substrate for use in an antenna array, the method comprising:

forming a top ground plane;

etching patch radiating elements from the top ground plane;

forming a bottom ground plane;

connecting the top and bottom ground planes around a plurality of element perimeters to form a plurality of proximity coupled cavity backed patch antenna elements; and forming distribution traces extending along an inner conductive layer and coupling with the antenna elements.

30. The method of claim 29, further comprising coupling the multi-layer substrate with another multi-layer substrate to form a co-planar array.

31. The method of claim 29, wherein the distribution traces comprise stripline traces.

32. The method of claim 29, wherein the distribution traces comprise a first portion coupling proximity coupled cavity back patch antenna elements in parallel and a second portion coupling proximity coupled cavity backed patch antenna elements in series.

33. The method of claim 29, wherein the proximity coupled cavity backed patch antenna elements comprise three quarter wavelength dual stubs.

34. The method of claim 29, further comprising forming a feed combiner proximate to and electrically coupling to the distribution trace.

35. The method of claim 29, wherein the couplers are formed with a load.

36. A method of forming an antenna array, the method comprising:

forming a plurality of multi-layer substrates, including, for each multi-layer substrate;

forming a top ground plane;

etching patch radiating elements from the top ground plane;

forming a bottom ground plane;

connecting the top and bottom ground planes around a plurality of element perimeters to form a plurality of proximity coupled cavity backed patch antenna elements; and forming distribution traces extending along an inner conductive layer and coupling with the antenna elements; and, electrically coupling the plurality of multi-layer substrates to one another.

37. The method of claim 36, wherein the distribution traces comprise stripline traces.

38. The method of claim 36, wherein the distribution traces comprise a first portion coupling proximity coupled cavity back patch antenna elements in parallel and a second portion coupling proximity coupled cavity backed patch antenna elements in series.

39. The method of claim 36, wherein the proximity coupled cavity backed patch antenna elements comprise three quarter wavelength dual stubs.

40. The method of claim 36, further comprising forming a feed combiner proximate to and electrically coupling to the distribution trace.

41. The method of claim 36, wherein the couplers are formed with a load.

* * * * *

UNITED STATES PATENT AND TRADEMARK OFFICE

CERTIFICATE OF CORRECTION

PATENT NO. : 6,885,343 B2
APPLICATION NO. : 10/255305
DATED : April 26, 2005
INVENTOR(S) : Joel C. Roper It is certified that error appears in the above-identified patent and that said Letters Patent is hereby corrected as shown below:

Column 1, line 33, read "Point-to-point backhauls, are currently" and should read --point-to-point backhauls are currently--

Column 2, line 42, reads "FIG. 2 is diagram showing a" and should read --FIG. 2 is a diagram showing a--

Column 3, line 27-28, reads "capabilities or circuit board manufactures." And should read --capabilities of circuit board manufacturers--.

Column 3, line 51, reads "about the inner most edges of" and should read --about the innermost edges of--

Column 5, line 30-31, reads "only the outer most four" and should read --only the outer most four--

Column 5, line 42, reads "within respectively column 16," and should read --within a respective column 16,--

Column 5, line 62, reads "limited to the specific details representative apparatus and method, and illustrative examples"
and should read --limited to the specific details, representative apparatus and method, and illustrative examples--

Column 6, line 8 CLAIM 1, reads "each proximity coupled cavity back patch" and should read --each proximity coupled cavity backed patch--

Column 6, line 23 CLAIM 4, reads "proximity coupled cavity back patch" and should read --proximity coupled cavity backed patch--

Column 6, line 28, CLAIM 5 reads "three quarter wavelength" and should read --three-quarter wavelength--

UNITED STATES PATENT AND TRADEMARK OFFICE

CERTIFICATE OF CORRECTION

PATENT NO. : 6,885,343 B2
APPLICATION NO. : 10/255305
DATED : April 26, 2005
INVENTOR(S) : Joel C. Roper It is certified that error appears in the above-identified patent and that said Letters Patent is hereby corrected as shown below:

Column 6, line 53, CLAIM 12, reads "proximity coupled cavity back patch" and should read --proximity coupled cavity backed patch--

Column 6, line 63, CLAIM 13, reads "to forma coplanar array." and should read --to form a coplanar array--

Column 7, line 1, CLAIM 15, reads "coupled cavity back patch antenna" and should read --coupled cavity backed patch antenna--

Column 7, line 6, CLAIM 16, reads "three quarter wavelength" and should read --three-quarter wavelength--

Column 7, line 41, CLAIM 24, reads "three quarter wavelength" and should read --three-quarter wavelength--

Column 8, line 18 CLAIM 32, reads "cavity back patch antenna" and should read --cavity backed patch antenna--

Column 8, line 20, CLAIM 33, reads "three quarter wavelength" and should read --three-quarter wavelength--

UNITED STATES PATENT AND TRADEMARK OFFICE

CERTIFICATE OF CORRECTION

PATENT NO. : 6,885,343 B2
APPLICATION NO. : 10/255305
DATED : April 26, 2005
INVENTOR(S) : Joel C. Roper It is certified that error appears in the above-identified patent and that said Letters Patent is hereby corrected as shown below:

Column 8, line 29, rewrite CLAIM 36 as follows to show the correct indented format 36. A method of forming an antenna array, the method comprising: forming a plurality of multi-layer substrates, including, for each multi-layer substrate:
forming a top ground plane;
etching patch radiating elements from the top ground plane;
forming a bottom ground plane;
connecting the top and bottom ground planes around a
plurality of element perimeters to form a plurality of proximity
coupled cavity backed patch antenna elements; and
forming distribution traces extending along an inner conductive layer
and coupling with the antenna elements; and, electrically coupling the plurality of multi-layer substrates to one another.

Column 8, line 47, CLAIM 38, reads “cavity back patch antenna” and should read --cavity backed patch antenna--

Column 8, line 52, CLAIM 39, reads “three quarter wavelength” and should read --three-quarter wavelength--

Signed and Sealed this

First Day of August, 2006

JON W. DUDAS
*Director of the United States Patent and Trademark Office*